United States Patent [19]

Goldblatt et al.

[11] Patent Number: 4,705,641

[45] Date of Patent: Nov. 10, 1987

[54] COPPER MOLYBDENUM SALTS AS ANTIOXIDANTS

[75] Inventors: Irwin L. Goldblatt, Edison, N.J.; Leah T. Mendelson, Santa Ana, Calif.

[73] Assignee: Exxon Research and Engineering Company, Florham Park, N.J.

[21] Appl. No.: 906,934

[22] Filed: Sep. 15, 1986

[51] Int. Cl.[4] ..... C10M 129/26

[52] U.S. Cl. ..... 252/35; 252/37; 252/37.5; 252/400.1; 252/400.54

[58] Field of Search ..... 252/35, 37, 37.5, 400.54, 252/400.1

[56] References Cited

U.S. PATENT DOCUMENTS

| | | | |
|---|---|---|---|
| 2,873,178 | 2/1959 | Biswell | 252/35 |
| 3,262,881 | 7/1966 | Ravner et al. | 252/37.7 |
| 3,518,287 | 6/1970 | Rinse | 252/35 |
| 3,598,847 | 8/1971 | Larson | 252/35 |
| 4,122,033 | 10/1978 | Black | 252/400.23 |

*Primary Examiner*—Jacqueline V. Howard

*Attorney, Agent, or Firm*—Joseph J. Dvorak; John W. Ditsler

[57] ABSTRACT

The combination of copper and molybdenum salts is shown to be an effective antioxidant and anti-wear additive for hydrocarbons, such as lube oils. Accordingly the present invention is directed to a lube oil having improved oxidation stability, providing improved wear protection with reduced friction and comprising:

A. a basestock, and

B. an effective amount of a copper salt and a molybdenum salt.

11 Claims, 1 Drawing Figure

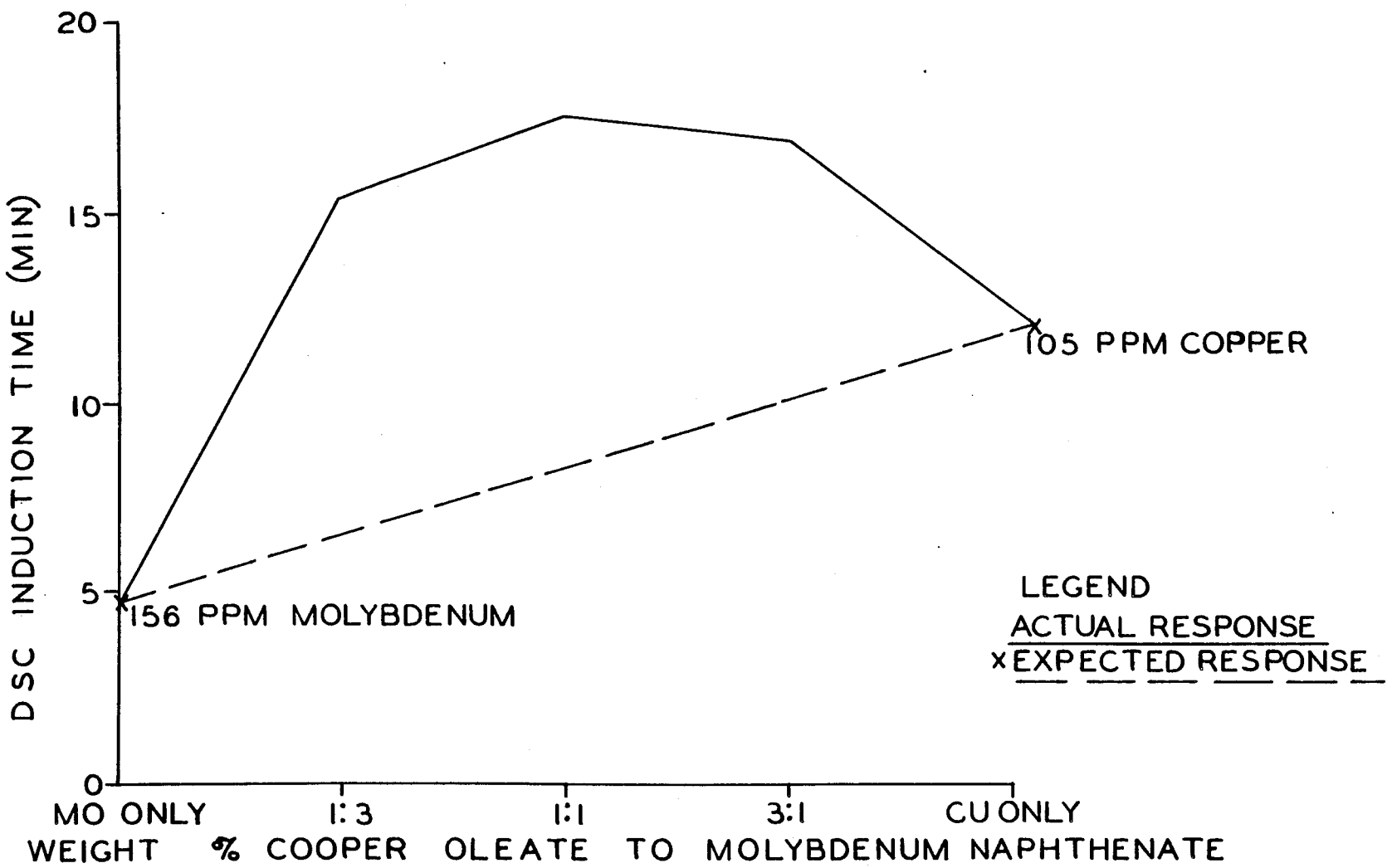
DSC INDUCTION TIME (MIN)
20
15
10
5
0
105 PPM COPPER
156 PPM MOLYBDENUM
LEGEND
ACTUAL RESPONSE
EXPECTED RESPONSE
MO ONLY
1:3
1:1
3:1
CU ONLY
WEIGHT % COOPER OLEATE TO MOLYBDENUM NAPHTHENATE

COPPER MOLYBDENUM SALTS AS ANTIOXIDANTS

BACKGROUND OF THE INVENTION

The present invention is directed at an organic material having improved oxidation stability and/or improved anti-wear properties. More specifically, the present invention is directed at an improved lube oil comprising a basestock, and salts of copper and molybdenum.

Organic compounds, particularly those comprising relatively long hydrocarbon segments, are subject to autoxidation when they are contacted with oxygen. This, in turn, results in the deterioration of the base material, often leading to increases in the total acidity and sludge formation.

Several methods previously have been proposed to prevent or minimize autoxidation. In one method, certain reducing agents are used which are selectively oxidized by oxygen present, thereby preventing the formation of undesired oxygenated compounds, such as hydroperoxides.

In another process, peroxide removers or decomposers are utilized which complex with or decompose the peroxide immediately after formation to a product which will not produce additional free radicals.

In another process, materials generally classified as peroxide removers or decomposers are utilized.

U.S. Pat. No. 4,122,033 discloses an oxidation inhibitor and a method for using the oxidation inhibitor for hydrocarbon materials, particularly lube oils. This patent discloses that one or more transition metal containing compounds can be utilized in combustion with one or more other peroxide decomposer compounds as oxidation inhibitors in organic compositions subject to autoxidation. Among the transition metal compounds useful according to the patent are the salts of scandium, titanium, vanadium, chromium, manganese, iron, cobalt, nickel, copper, yttrium, zirconium, niobium, molybdenum, tellurium, ruthenium, rhodium, palladium, and silver, to mention a few. This patent further states, at column 8, that when a combination of metals is used a synergistic effect will be noted if the sum of electromotive force voltages favors the presence of the stronger inhibitor and/or the weaker catalyst and is, generally, positive. Additionally the combination will be effective as a corrosion inhibitor at concentrations of about 100 ppm by weight, or less, when the amount of peroxide decomposer complexing agents or the like approaches 20,000 ppm by weight. In effect the effectiveness of the transition metal compounds is dependent upon relatively high concentrations of the peroxide decomposer compounds. For this and other reasons there remains a need for an additive for a lube oil having improved oxidation performance.

It also would be desirable to provide an additive for a lube oil which would permit the level of phosphorus in the lube oil to be lowered without adversely affecting the oxidative stability of the lube oil.

It also would be advantageous to provide a lube oil having improved anti-wear properties as compared to currently available products.

SUMMARY OF THE INVENTION

Accordingly, the present invention is directed to a lube oil having improved oxidation stability and anti-wear properties comprising:

A. a basestock; and

B. an effective amount of copper salt and molybdenum salt.

The total concentration of copper salt and molybdenum salt are such that the concentration of metal or metal ion may range from about 0.006 weight percent to about 0.5 weight percent, preferably from about 0.009 weight percent to about 0.1 weight percent of the basestock. The concentration of the copper salt may range between about 0.002 weight percent and about 0.3 weight percent, preferably between about 0.005 weight percent and about 0.1 weight percent, while the concentration of the molybdenum salt ranges between about 0.004 weight percent and about 0.3 weight percent, preferably between about 0.005 weight percent and about 0.1 weight percent. The copper salt preferably is selected from the group of carboxylates consisting of oleates, stearates, naphthenates and mixtures thereof. The molybdenum salt preferably is selected from the group of carboxylates consisting of naphthenates, oleates, stearates and mixtures thereof.

A particularly preferred lube oil comprises:

A. a basestock;

B. about 0.002 to about 0.1 weight percent copper oleate; and

C. about 0.004 to about 0.1 weight percent molybdenyl naphthenate.

BRIEF DESCRIPTION OF THE DRAWING

The accompanying FIGURE illustrates the improved oxidation stability of the lube oil of the invention and is a plot of the differential scanning colorimetry induction time (a measure of oxidation stability) as a function of relative-amounts of copper oleate and molybdenyl naphthenate present.

DETAILED DESCRIPTION OF THE INVENTION

The present invention is directed at a lube oil having improved oxidation stability and wear resistance as compared to present commercially available lube oils. The improved oxidation stability and wear resistance are achieved by the addition of a copper salt and a molybdenum salt to basestock. The total copper and molybdenum metal or ion concentration in solution may range between about 0.006 weight percent to about 0.5 weight percent, preferably between about 0.009 weight percent and about 0.1 weight percent. The concentration of the copper salt may range between about 0.002 weight percent and about 0.3 weight percent, preferably between about 0.005 weight percent and about 0.1 weight percent. The concentration of the molybdenum salt may range between about 0.004 weight percent and about 0.3 weight percent, preferably between about 0.005 weight percent and about 0.1 weight percent. The anion portions of the copper salt and of the molybdenum salt may be in essentially any form, including both organic and inorganic. However, it is essential that the anion portion of each salt be compatible with the other constituents of the system. Each salt may be derived from an organic and/or inorganic acid. When an organic acid is used the same may be aromatic, naphthenic, aliphatic, cyclic, branched or a combination of any one or all of these. Moreover, the same may comprise essentially any number of carboxylic acid groups, especially from about 1 to about 6, but acids having only one carboxylic acid group are most preferred. When an inorganic acid, on the other hand, is used, the same may be derived from either a week or strong acid. Compatibility in the system in which the same will be used will be the principal controlling criteria. In this regard, however, it should be noted that the use of weak acids is, generally, preferred since salts derived from strong acids could lead to an increase in total acid number in the organic composition in which the same is used. Also, care should be used in selecting a particular anion moiety so as to ensure that materials which might emit pollutants to the atmosphere are not used.

Notwithstanding that a broad range of anion sources could be used in the salt portion of the inhibitor composition of this invention, the same will, generally, be derived from a carboxylic acid comprising from about 1 to about 50 and preferably from about 8 to about 20 carbon atoms. Moreover, the organic moiety would, generally, be aromatic, naphthenic, aliphatic, cycloaliphatic, or a combination of one or more of these. In a most preferred embodiment, the anion portion of the salt will be derived from a monocarboxylic fatty acid having from about 8 to about 18 carbon atoms.

Particularly preferred copper salts are salts selected from the group consisting of oleates, stearates, naphthenates and mixtures thereof. Copper oleate is particularly preferred, because of its relatively low cost.

Particularly preferred molybdenum salts are salts selected from the group consisting of naphthenates, oleates, stearates and mixtures thereof. Molybdenum naphthenate is particularly preferred, because of its relatively low cost.

The utility of the present invention may be seen from the following comparative examples and examples.

COMPARATIVE EXAMPLE 1

A series of oxidation tests were conducted on solvent 150 neutral oil, a solvent extracted basestock having a viscosity ranging from about 29.0 to about 31.0 cs at 40° C., which corresponds to about 150–160 SUS at 100° F. A series of Rotary Bomb Oxidation Tests (RBOT) were performed. These tests were performed according to the procedure set forth in ASTM D2272-67, the disclosure of which is incorporated herein by reference. In each test 50±0.5 g of the test oil was placed in an 18-8 stainless steel bomb having a capacity of about 300 ml. The sample was pressurized to 621 KPa gauge with oxygen and maintained at 150° C. by a constant pressure bath. The oxygen pressure in the bomb decreases as the solution becomes oxidized. The RBOT life was determined to be that period of time from the start of the test until the pressure in the bomb dropped 172 KPa below the maximum pressure. Tests were conducted on the solvent 150 neutral oil with no additives, with only 0.1 wt % copper dithiocarbamate (DTC) added, and with only 0.1 wt % molybdenum naphthenate added. These results are presented in Table I. From these results it can be seen that each of the additives improved the oxidation stability of the solvent 150 neutral oil, as compared with the case in which no additives were used.

EXAMPLE 1

Tests also were conducted in a manner similar to that described in Comparative Example 1 on solvent 150 neutral to which both copper DTC and molybdenum naphthenate were added. In one test 0.03 wt % copper DTC and 0.07 wt % molybdenum naphthenate were used in combination.

In another test 0.05 wt % copper DTC and 0.05 wt % molybdenum naphthenate were both used. Also in another test 0.01 wt % copper DTC and 0.09 wt % molybdenum naphthenate were used. These results also are presented in Table I. From a review of Table I, it may be seen that molybdenum naphthenate is a more effective antioxidant than copper oleate, and that the combination of the copper and molybdenum salts is a more effective oxidation inhibitor than either salt alone.

TABLE I

RBOT LIFE FOR SOLVENT 150 NEUTRAL BLENDS

| Additive in Solvent 150 Neutral | Concentration wt % | RBOT Life Minutes |
|---|---|---|
| None | — | <27 |
| Copper Dithiocarbamate | 0.1 | 28 |
| Molybdenum Naphthenate | 0.1 | 66 |
| Copper Dithiocarbamate and Molybdenum Naphthenate | 0.05 | 48 |
| Copper Dithiocarbamate and Molybdenum Naphthenate | 0.03<br>0.07 | 103 |
| Copper Dithiocarbamate and Molybdenum Naphthenate | 0.01<br>0.09 | 37 |

COMPARATIVE EXAMPLE 2

Oxidation stability tests also were conducted on SAE Grade 10W-30 type motor oil to which copper oleate or molybdenum naphthenate were added. The oxidation stability was measured by differential scanning colorimetry (DSC) tests as described by R. L. Blaine in "Thermal Analytical Characterization of Oils and Lubricants", American Laboratory, Vol. 6, pp 460–463 (January, 1974) and F. Noel and G. E. Cranton in "Application of Thermal Analysis to Petroleum Research", American Laboratory, Vol. 11, pp 27–50 (June, 1979), the disclosures of which are incorporated herein by reference. The DSC head was programmed from 50° C. to 210° C. at 100° C. per minute and held isothermally at 210° C. An oxygen atmosphere maintained at 69 KPa was used. In this test procedure the induction time is measured until an exothermic release of heat marks the onset of the oxidation reaction. As shown in Table II and the FIGURE, molybdenum naphthenate was found to be less effective antioxidant than copper oleate at equivalent molar and weight concentrations, since the induction time for molybdenum naphthenate was found to be less than for copper oleate.

EXAMPLE 2

Additional DSC tests were run on lube basestocks similar to those in Comparative Example 2, to which varying amounts of copper oleate and molybdenum naphthenate were added. These results also are shown in Table II and the FIGURE. From the plot of these results it can be seen that the combination of copper oleate and molybdenum napthenate produces a synergistic increase in the oxidation stability.

TABLE II

DSC INDUCTION TIMES FOR MOTOR OIL BLENDS

| Additives (wt. %) | | | |
|---|---|---|---|
| Copper Oleate | Molybdenum Naphthenate | Total Wt % Additive | DSC Induction Time (Min.) |
| 0.26 | 0.26 | 0.52 | 22.7 |
| 0.26 | 0.14 | 0.40 | 16.3 |
| 0.26 | 0.10 | 0.36 | 16.8 |
| 0.26 | 0.05 | 0.31 | 15.5 |
| 0.26 | 0 | 0.26 | 12.1 |
| 0.13 | 0.13 | 0.26 | 17.2 |
| 0.065 | 0.065 | 0.13 | 16.2 |
| 0 | 0.26 | 0.26 | 5.0 |

Tests also were conducted on basestocks to determine the effect of copper and molybdenum salts on wear reduction.

COMPARATIVE EXAMPLE 3

A standard test for determining the performance of various lubricants in reducing wear is the Four Ball Machine Tests. In this test, conducted at atmospheric pressure under a 35 kg load, 1200 rpm for 30 minutes, lube oils maintained at 100° C. were evaluated to determine the relative wear scar diameter and relative wear volume.

The results are presented in Table III for a lube oil having an SAE 10W-30 grade with only copper oleate or molybdenum naphthenate added. From a review of the data in Table III it can be seen that molybdenum naphthenate alone actually caused an increase in the relative wear, relative to the copper oleate additive.

EXAMPLE 3

In this test, conducted under the same conditions as Comparative Example 3, both copper oleate and molybdenum naphthenate were added to the base lube. As shown in Table III, the addition of both salts resulted in a decrease in the wear scar diameter and in the relative wear. Use of the same levels of copper oleate and molybdenum naphthenate permits reduction in the ZDDP concentration, and therefore reduction in total additive treatment level without a diminution in wear protection.

TABLE III

FOUR BALL MACHINE TESTS FOR MOTOR OIL BLENDS

| Additives (wt. %) | | | | | |
|---|---|---|---|---|---|
| ZDDP | Copper Oleate | Molybdenum Naphthenate | Total wt % Additive | Wear Scan Diameter (mm) | Relative Wear Volume (Relative Wear Reduction) |
| 1.23 | | 0.26 | 1.49 | 0.43 | 1.00 |
| 1.23 | 0.26 | — | 1.49 | 0.40 | 0.75 |
| 1.23 | 0.13 | 0.13 | 1.49 | 0.39 | 0.67 |
| 1.23 | 0.26 | 0.26 | 1.75 | 0.37 | 0.55 |
| 0.61 | 0.13 | 0.13 | 0.87 | 0.40 | 0.75 |

COMPARATIVE EXAMPLE 4

Additional wear tests were conducted using the Ball-on-Cylinder Machine Test as described by I. L. Goldblatt in "The Use of Simulated Device to Evaluate the Wear Performance of Multigraded Engine Oils" SAE paper no. 770376, (1977), the disclosure of which is incorporated herein by reference. This test complements the Four Ball Machine and in addition provides information about the friction reducing properties of additives. The test was conducted in a Ball-on-Cylinder Machine utilizing wet air, atmospheric blanketing, a 4,000 g load, a cylinder rotational speed of 0.25 revolutions per minute and a temperature of 104° C. Tests were conducted for about 80 minutes. The cross sectional cylinder area, relative wear reduction and coefficient of friction were measured on a motor oil to which 0.26 wt. % copper oleate had been added and on a motor oil to which 0.26 wt. % molybdenum naphthenate had been added. Those results are presented in Table IV. From a review of this data it can be seen that copper oleate and molybdenum naphthenate produced substantially equivalent results in terms of both the cross sectional cylinder area and the coefficient of friction.

EXAMPLE 4

Tests also were conducted in a Ball-on-Cylinder Machine using the same test conditions and a similar motor oil as in Comparative Example 4. In one test 0.26 wt. % copper oleate and 0.26 wt. % molybenum naphthenate were added to the motor oil, while in another test 0.13 wt. % copper oleate and 0.13 wt. % molybdenum naphthenate were added to the motor oil. These test results also are presented in Table IV. From these results it can be seen that combination of molybdenum naphthenate and copper oleate resulted in reductions of both wear, as measured by cross sectional cylinder area and coefficient of friction.

TABLE IV

BALL-ON-CYLINDER MACHINE TESTS FOR MOTOR OIL BLENDS

| Additives (wt. %) | | | | | | |
|---|---|---|---|---|---|---|
| ZDDP | Copper Oleate | Molybdenum Naphthenate | Total wt % Additives | Cross Sectional Cylinder Area ($cm^2$) | Relative Wear Volume (Relative Wear Reduction) | Coefficient of Friction |
| 1.22 | — | 0.26 | 1.48 | 1.53 | 1.0 | 0.13 |
| 1.22 | 0.26 | — | 1.48 | 1.50 | 0.98 | 0.13 |
| 1.22 | 0.26 | 0.26 | 1.74 | 1.28 | 0.84 | 0.12 |
| 1.22 | 0.13 | 0.13 | 1.48 | 1.12 | 0.73 | 0.11 |
| 0.61 | 0.13 | 0.13 | 0.87 | 1.47 | 0.96 | 0.12 |

COMPARATIVE EXAMPLE 5

A series of oxidation tests were conducted on a fully formulated SAE 10W-30 passenger car engine oils using a Panel Coker Tester. The Panel Coker Tester is described in Federal Test Method 3462. In the procedure followed in these tests, the sump oil was heated to 150°

C. and the panel was heated to 330° C. These temperatures were established to accelerate viscosity increase which was the performance parameter used to evaluate the motor oils. Lower percent viscosity increase indicates improved lubricant quality. In the test, about 250 gms. of test oil are placed in the lubricant reservoir and air is bubbled into the test oil. The test is run for four hours, with a 20 cc sample being taken after two hours of operation. After sampling a 40 cc sample of fresh make-up is added.

The results are presented in Table V for an SAE 10W-30 passenger car oil containing only copper oleate or molybdenum naphthenate. From the data presented, the percent viscosity increase for the formulation containing either copper oleate or molybdenum naphthenate alone is comparable, being equal to about 62%.

EXAMPLE 5

In this test, conducted under the same conditions as Comparative Example 2, both copper oleate and molybdenum napthenate were added together to the passenger car engine oil. As shown in Table VI, the addition of both salts together significantly reduces the percent viscosity increase as compared with the use of either salt alone. Furthermore, a 50:50 mixture of the two salts appears to result in a lower percent viscosity increase as compared with the other combinations tested.

TABLE V

PANEL COKER RESULTS FOR MOTOR OIL BLEND

| Concentration of Additive (wt %) | | Total | Percent |
|---|---|---|---|
| Copper Oleate | Molybdenum Naphthenate | Wt. % Additive | Viscosity Increase |
| 0.0 | 0.26 | 0.26 | 62 |
| 0.26 | 0.0 | 0.26 | 62 |
| 0.065 | 0.195 | 0.26 | 46 |
| 0.13 | 0.13 | 0.26 | 31 |
| 0.195 | 0.065 | 0.26 | 55 |

What is claimed is:

1. A lube oil having improved oxidation stability comprising:

A. a basestock; and

B. a copper salt and a molybdenum salt wherein the total concentration of the copper and molybdenum metal or metal ions in solution ranges between about 0.006 and about 0.5 weight percent of the basestock.

2. The lube oil of claim 1 wherein the concentration of the copper salt ranges between about 0.002 weight percent and about 0.3 weight percent of the basestock.

3. The lube oil of claim 2 wherein the total concentration of the copper and molybdenum metal or metal ions in solution ranges between about 0.009 and about 0.1 weight percent of the basestock.

4. The lube oil of claim 2 wherein the concentration of the molybdenum salt ranges between about 0.004 weight percent and about 0.3 weight percent of the basestock.

5. The lube oil of claim 4 wherein the concentration of the molybdenum salt ranges between about 0.005 weight percent and about 0.1 weight percent of the basestock.

6. The lube oil of claim 1 wherein the copper salt is selected from the group of carboxylates consisting of naphthenates, oleates, stearates and mixtures thereof.

7. The lube oil of claim 6 wherein the molybdenum salt is selected from the group of carboxylates consisting of oleates, stearates and mixtures thereof.

8. The lube oil of claim 7 wherein the molybdenum salt comprises molybdenum naphthenate.

9. The lube oil of claim 8 wherein the copper salt comprises copper oleate.

10. The lube oil of claim 4 wherein the molybdenum salt comprises molybdenum naphthenate.

11. The lube oil of claim 10 wherein the copper salt comprises copper oleate.

* * * * *